US007328149B2

(12) United States Patent
Jiang et al.

(10) Patent No.: US 7,328,149 B2
(45) Date of Patent: Feb. 5, 2008

(54) AUDIO SEGMENTATION AND CLASSIFICATION

(75) Inventors: Hao Jiang, Beijing (CN); Hongjiang Zhang, Beijing (CN)

(73) Assignee: Microsoft Corporation, Redmond, WA (US)

( * ) Notice: Subject to any disclaimer, the term of this patent is extended or adjusted under 35 U.S.C. 154(b) by 245 days.

(21) Appl. No.: 10/998,766

(22) Filed: Nov. 29, 2004

(65) Prior Publication Data

US 2005/0075863 A1 Apr. 7, 2005

Related U.S. Application Data

(63) Continuation of application No. 09/553,166, filed on Apr. 19, 2000, now Pat. No. 6,901,362.

(51) Int. Cl.
*G10L 11/04* (2006.01)

(52) U.S. Cl. ..... 704/207; 704/211

(58) Field of Classification Search ..... 704/207, 704/211

See application file for complete search history.

(56) References Cited

U.S. PATENT DOCUMENTS 4,559,602 A 12/1985 Bates, Jr.
4,933,973 A 6/1990 Porter
5,152,007 A 9/1992 Uribe
5,307,441 A 4/1994 Tzeng
5,473,727 A 12/1995 Nishiguchi et al.
5,596,680 A 1/1997 Chow et al.
5,630,012 A 5/1997 Nishiguchi et al.
5,664,052 A 9/1997 Nishiguchi et al.
5,809,455 A 9/1998 Nishiguchi et al.
5,828,996 A 10/1998 Iijima et al.
5,848,347 A 12/1998 Kuo et al.
5,878,388 A 3/1999 Nishiguchi et al.
5,911,128 A 6/1999 DeJaco
5,930,749 A * 7/1999 Maes ..... 704/228
5,960,388 A 9/1999 Nishiguchi et al.
6,054,646 A 4/2000 Pal et al.
6,078,880 A 6/2000 Zinser, Jr. et al.
6,456,964 B2 9/2002 Manjunath et al.
6,493,665 B1 12/2002 Su et al.
6,507,814 B1 1/2003 Gao (Continued)

OTHER PUBLICATIONS

Multi-band CELP coding of speech and music;Ubale, A.; Gersho, A.; □□Speech Coding For Telecommunications Proceeding, 1997, 1997 IEEE Workshop on □□Sep. 7-10, 1997 pp. 101-102.*

(Continued)

*Primary Examiner*—Michael N Opsasnick
(74) *Attorney, Agent, or Firm*—Lee & Hayes, PLLC

(57) ABSTRACT

A portion of an audio signal is separated into multiple frames from which one or more different features are extracted. These different features are used, in combination with a set of rules, to classify the portion of the audio signal into one of multiple different classifications (for example, speech, non-speech, music, environment sound, silence, etc.). In one embodiment, these different features include one or more of line spectrum pairs (LSPs), a noise frame ratio, periodicity of particular bands, spectrum flux features, and energy distribution in one or more of the bands. The line spectrum pairs are also optionally used to segment the audio signal, identifying audio classification changes as well as speaker changes when the audio signal is speech.

8 Claims, 5 Drawing Sheets

U.S. PATENT DOCUMENTS 6,694,293 B2 * 2/2004 Benyassine et al. ..... 704/229

OTHER PUBLICATIONS

A comparison of features for speech, music discrimination Carey, M.J.; Parris, E.S.; Lloyd-Thomas, H.; Acoustics, Speech, and Signal Processing, 1999. ICASSP '99. vol. 1, Mar. 15-19, 1999 pp. 149-152 vol. 1.*

Scheirer et al, "Construction and Evaluation of a Robust Multifeature Speech/Music Discriminator", 1997, IEEE, pp. 1331-1334.

Saunders, "Real-time Discrimination of Broadcast Speech/Music", JASSP, 1996, pp. 993-996.

Tong Zhang and C.-C. Jay Kuo, "Heuristic Approach for Generic Audio Data Segmentation and Annotation," ACM Multimedia Conference, Orlando, Florida, Nov. 1999, pp. 67-76.

Don Kimber and Lynn Wilcox, "Acoustic Segmentation for Audio Browsers," Proc. Interface Conference, Sydney, Australia, Jul. 1996.

Joseph P. Campbell, Jr., "Speaker Recognition: A Tutorial," Proceedings of the IEEE, vol. 85, No. 9, Sep. 1997, pp. 1437-1462.

John Saunders, "Real-Time Discrimination of Broadcast Speech/Music," Sanders, A Lockheed Martin Co., Nashua, NH, 1996 IEEE, pp. 993-996.

* cited by examiner

AUDIO SEGMENTATION AND CLASSIFICATION

RELATED APPLICATIONS

This is a continuation of U.S. patent application Ser. No. 09/553,166, filed Apr. 19, 2000, now U.S. Pat. No. 6,901,362 entitled "Audio Segmentation and Classification" to Hao Jiang and Hongjiang Zhang, which is hereby incorporated by reference herein.

TECHNICAL FIELD

This invention relates to audio information retrieval, and more particularly to segmenting and classifying audio.

BACKGROUND OF THE INVENTION

Computer technology is continually advancing, providing computers with continually increasing capabilities. One such increased capability is audio information retrieval. Audio information retrieval refers to the retrieval of information from an audio signal. This information can be the underlying content of the audio signal (e.g., the words being spoken), or information inherent in the audio signal (e.g., when the audio has changed from a spoken introduction to music).

One fundamental aspect of audio information retrieval is classification. Classification refers to placing the audio signal (or portions of the audio signal) into particular categories. There is a broad range of categories or classifications that would be beneficial in audio information retrieval, including speech, music, environment sound, and silence. Currently, techniques classify audio signals as speech or music, and either do not allow for classification of audio signals as environment sound or silence, or perform such classifications poorly (e.g., with a high degree of inaccuracy).

Additionally, when the audio signal represents speech, separating the audio signal into different segments corresponding to different speakers could be beneficial in audio information retrieval. For example, a separate notification (such as a visual notification) could be given to a user to inform the user that the speaker has changed. Current classification techniques either do not allow for identifying speaker changes or identify speaker changes poorly (e.g., with a high degree of inaccuracy).

The improved audio segmentation and classification described below addresses these disadvantages, providing improved segmentation and classification of audio signals.

SUMMARY OF THE INVENTION

Improved audio segmentation and classification is described herein. A portion of an audio signal is separated into multiple frames from which one or more different features are extracted. These different features are used to classify the portion of the audio signal into one of multiple different classifications (for example, speech, non-speech, music, environment sound, silence, etc.).

According to one aspect, line spectrum pairs (LSPs) are extracted from each of the multiple frames. These LSPs are used to generate an input Gaussian Model representing the portion. The input Gaussian Model is compared to a codebook of trained Gaussian Model and the distance between the input Gaussian Model and the closest trained Gaussian Model is determined. This distance is then used, optionally in combination with an energy distribution of the multiple frames in one or more bandwidths, to determine whether to classify the portion as speech or non-speech.

According to another aspect, one or more periodicity features are extracted from each of the multiple frames. These periodicity features include, for example, a noise frame ratio indicating a ratio of noise-like frames in the portion, and multiple band periodicities, each indicating a periodicity in a particular frequency band of the portion. A full band periodicity may also be determined, which is a combination (e.g., a concatenation) of each of the multiple individual band periodicities. These periodicity features are then used, individually or in combination, to discriminate between music and environment sound. Other features may also optionally be used to determine whether the portion is music or environment sound, including spectrum flux features and energy distribution in one or more of the multiple bands (either the same bands as were used for the band periodicities, or different bands).

According to another aspect, the audio signal is also segmented. The segmentation identifies when the audio classification changes as well as when the current speaker changes (when the audio signal is speech). Line spectrum pairs extracted from the portion of the audio signal are used to determine when the speaker changes. In one implementation, when the difference between line spectrum pairs for two frames (or alternatively windows of multiple frames) is a local peak and exceeds a threshold value, then a speaker change is identified as occurring between those two frames (or windows).

BRIEF DESCRIPTION OF THE DRAWINGS

The present invention is illustrated by way of example and not limitation in the figures of the accompanying drawings. The same numbers are used throughout the figures to reference like components and/or features.

DETAILED DESCRIPTION

In the discussion below, embodiments of the invention will be described in the general context of computer-executable instructions, such as program modules, being executed by one or more conventional personal computers. Generally, program modules include routines, programs, objects, components, data structures, etc. that perform particular tasks or implement particular abstract data types. Moreover, those skilled in the art will appreciate that various embodiments of the invention may be practiced with other computer system configurations, including hand-held devices, multiprocessor systems, microprocessor-based or programmable consumer electronics, network PCs, minicomputers, mainframe computers, and the like. In a distributed computer environment, program modules may be located in both local and remote memory storage devices.

Alternatively, embodiments of the invention can be implemented in hardware or a combination of hardware, software, and/or firmware. For example, one implementation of the invention can include one or more application specific integrated circuits (ASICs).

In the discussions herein, reference is made to many different specific numerical values (e.g., frequency bands, threshold values, etc.). These specific values are exemplary only—those skilled in the art will appreciate that different values could alternatively be used.

Additionally, the discussions herein and corresponding drawings refer to different devices or components as being coupled to one another. It is to be appreciated that such couplings are designed to allow communication among the coupled devices or components, and the exact nature of such couplings is dependent on the nature of the corresponding devices or components.

Figure 1:
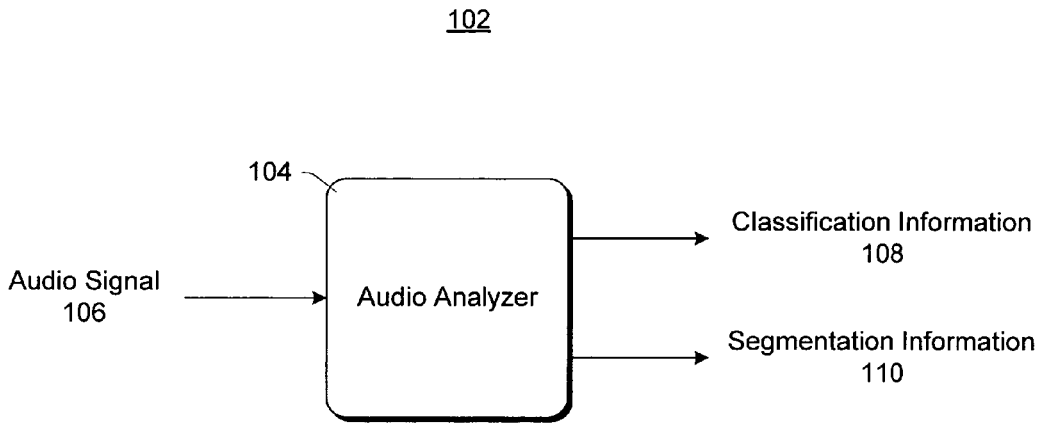
FIG. 1 is a block diagram illustrating an exemplary system for classifying and segmenting audio signals.

FIG. 1 is a block diagram illustrating an exemplary system for classifying and segmenting audio signals. A system 102 is illustrated including an audio analyzer 104. System 102 represents any of a wide variety of computing devices, including set-top boxes, gaming consoles, personal computers, etc. Although illustrated as a single component, analyzer 104 may be implemented as multiple programs. Additionally, part or all of the functionality of analyzer 104 may be incorporated into another program, such as an operating system, an Internet browser, etc.

Audio analyzer 104 receives an input audio signal 106. Audio signal 106 can be received from any of a wide variety of sources, including audio broadcasts (e.g., analog or digital television broadcasts, satellite or RF radio broadcasts, audio streaming via the Internet, etc.), databases (either local or remote) of audio data, audio capture devices such as microphones or other recording devices, etc.

Audio analyzer 104 analyzes input audio signal 106 and outputs both classification information 108 and segmentation information 110. Classification information 108 identifies, for different portions of audio signal 106, which one of multiple different classifications the portion is assigned. In the illustrated example, these classifications include one or more of the following: speech, non-speech, silence, environment sound, music, music with vocals, and music without vocals.

Segmentation information 110 identifies different segments of audio signal 106. In the case of portions of audio signal 106 classified as speech, segmentation information 110 identifies when the speaker of audio signal 106 changes. In the case of portions of audio signal 106 that are not classified as speech, segmentation information 110 identifies when the classification of audio signal 106 changes.

In the illustrated example, analyzer 104 analyzes the portions of audio signal 106 as they are received and outputs the appropriate classification and segmentation information while subsequent portions are being received and analyzed. Alternatively, analyzer 104 may wait until larger groups of portions have been received (or all of audio signal 106) prior to performing its analyzing.

Figure 2:
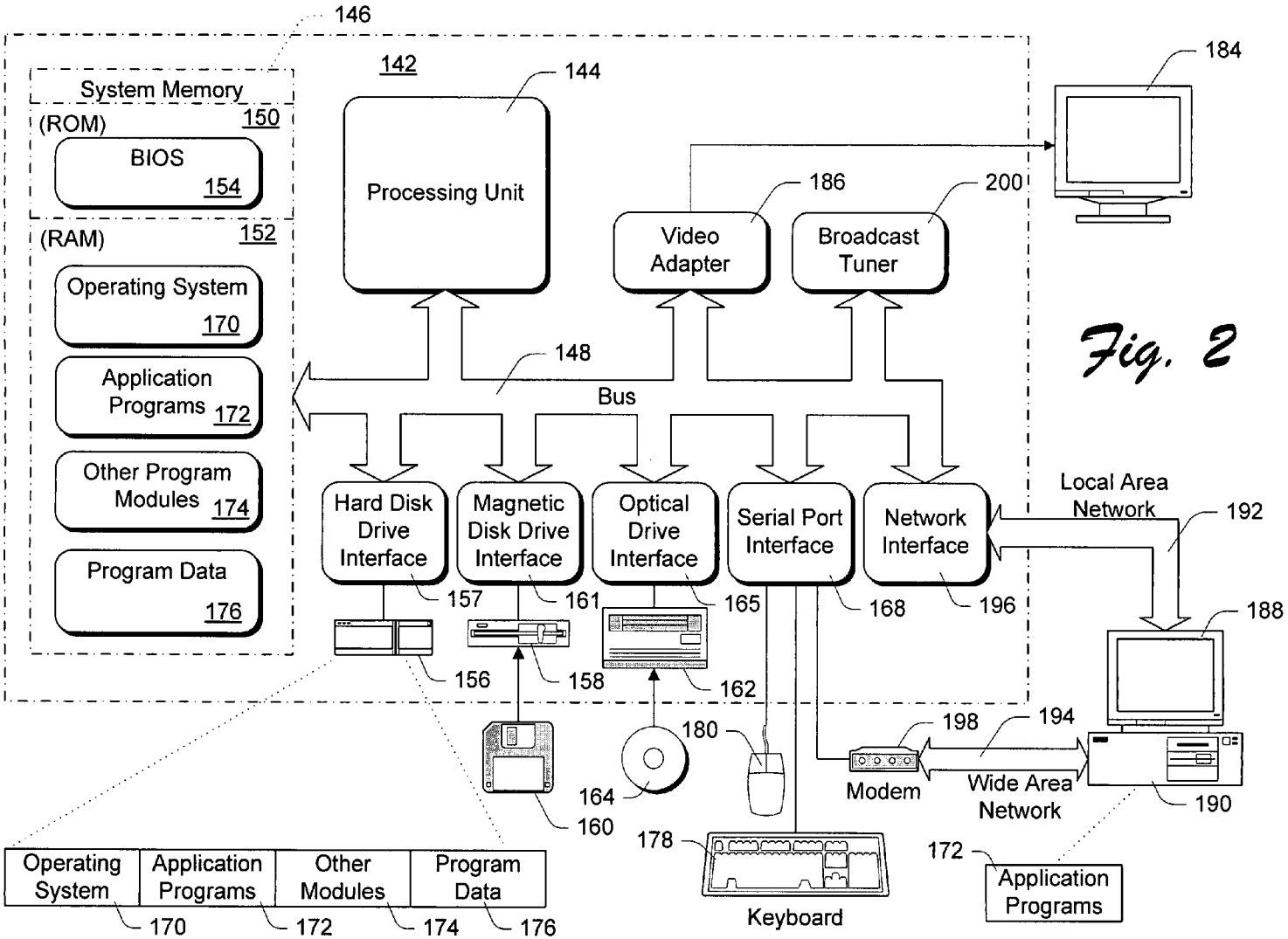
FIG. 2 shows a general example of a computer that can be used in accordance with one embodiment of the invention.

FIG. 2 shows a general example of a computer 142 that can be used in accordance with one embodiment of the invention. Computer 142 is shown as an example of a computer that can perform the functions of system 102 of FIG. 1. Computer 142 includes one or more processors or processing units 144, a system memory 146, and a bus 148 that couples various system components including the system memory 146 to processors 144.

The bus 148 represents one or more of any of several types of bus structures, including a memory bus or memory controller, a peripheral bus, an accelerated graphics port, and a processor or local bus using any of a variety of bus architectures. The system memory includes read only memory (ROM) 150 and random access memory (RAM) 152. A basic input/output system (BIOS) 154, containing the basic routines that help to transfer information between elements within computer 142, such as during start-up, is stored in ROM 150. Computer 142 further includes a hard disk drive 156 for reading from and writing to a hard disk, not shown, connected to bus 148 via a hard disk driver interface 157 (e.g., a SCSI, ATA, or other type of interface); a magnetic disk drive 158 for reading from and writing to a removable magnetic disk 160, connected to bus 148 via a magnetic disk drive interface 161; and an optical disk drive 162 for reading from or writing to a removable optical disk 164 such as a CD ROM, DVD, or other optical media, connected to bus 148 via an optical drive interface 165. The drives and their associated computer-readable media provide nonvolatile storage of computer readable instructions, data structures, program modules and other data for computer 142. Although the exemplary environment described herein employs a hard disk, a removable magnetic disk 160 and a removable optical disk 164, it should be appreciated by those skilled in the art that other types of computer readable media which can store data that is accessible by a computer, such as magnetic cassettes, flash memory cards, digital video disks, random access memories (RAMs) read only memories (ROM), and the like, may also be used in the exemplary operating environment.

A number of program modules may be stored on the hard disk, magnetic disk 160, optical disk 164, ROM 150, or RAM 152, including an operating system 170, one or more application programs 172, other program modules 174, and program data 176. A user may enter commands and information into computer 142 through input devices such as keyboard 178 and pointing device 180. Other input devices (not shown) may include a microphone, joystick, game pad, satellite dish, scanner, or the like. These and other input devices are connected to the processing unit 144 through an interface 182 that is coupled to the system bus. A monitor 184 or other type of display device is also connected to the system bus 148 via an interface, such as a video adapter 186. In addition to the monitor, personal computers typically include other peripheral output devices (not shown) such as speakers and printers.

Computer 142 can optionally operate in a networked environment using logical connections to one or more remote computers, such as a remote computer 188. The remote computer 188 may be another personal computer, a server, a router, a network PC, a peer device or other common network node, and typically includes many or all of the elements described above relative to computer 142, although only a memory storage device 190 has been illustrated in FIG. 2. The logical connections depicted in FIG. 2 include a local area network (LAN) 192 and a wide area network (WAN) 194. Such networking environments are commonplace in offices, enterprise-wide computer networks, intranets, and the Internet. In the described embodiment of the invention, remote computer 188 executes an Internet Web browser program such as the "Internet Explorer" Web browser manufactured and distributed by Microsoft Corporation of Redmond, Wash.

When used in a LAN networking environment, computer 142 is connected to the local network 192 through a network interface or adapter 196. When used in a WAN networking environment, computer 142 typically includes a modem 198 or other means for establishing communications over the wide area network 194, such as the Internet. The modem 198, which may be internal or external, is connected to the system bus 148 via a serial port interface 168. In a networked environment, program modules depicted relative to the personal computer 142, or portions thereof, may be stored in the remote memory storage device. It will be appreciated that the network connections shown are exemplary and other means of establishing a communications link between the computers may be used.

Computer 142 can also optionally include one or more broadcast tuners 200. Broadcast tuner 200 receives broadcast signals either directly (e.g., analog or digital cable transmissions fed directly into tuner 200) or via a reception device (e.g., via an antenna or satellite dish (not shown)).

Generally, the data processors of computer 142 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described. In addition, the invention described herein includes data structures, described below, as embodied on various types of memory media.

For purposes of illustration, programs and other executable program components such as the operating system are illustrated herein as discrete blocks, although it is recognized that such programs and components reside at various times in different storage components of the computer, and are executed by the data processor(s) of the computer.

Figure 3:
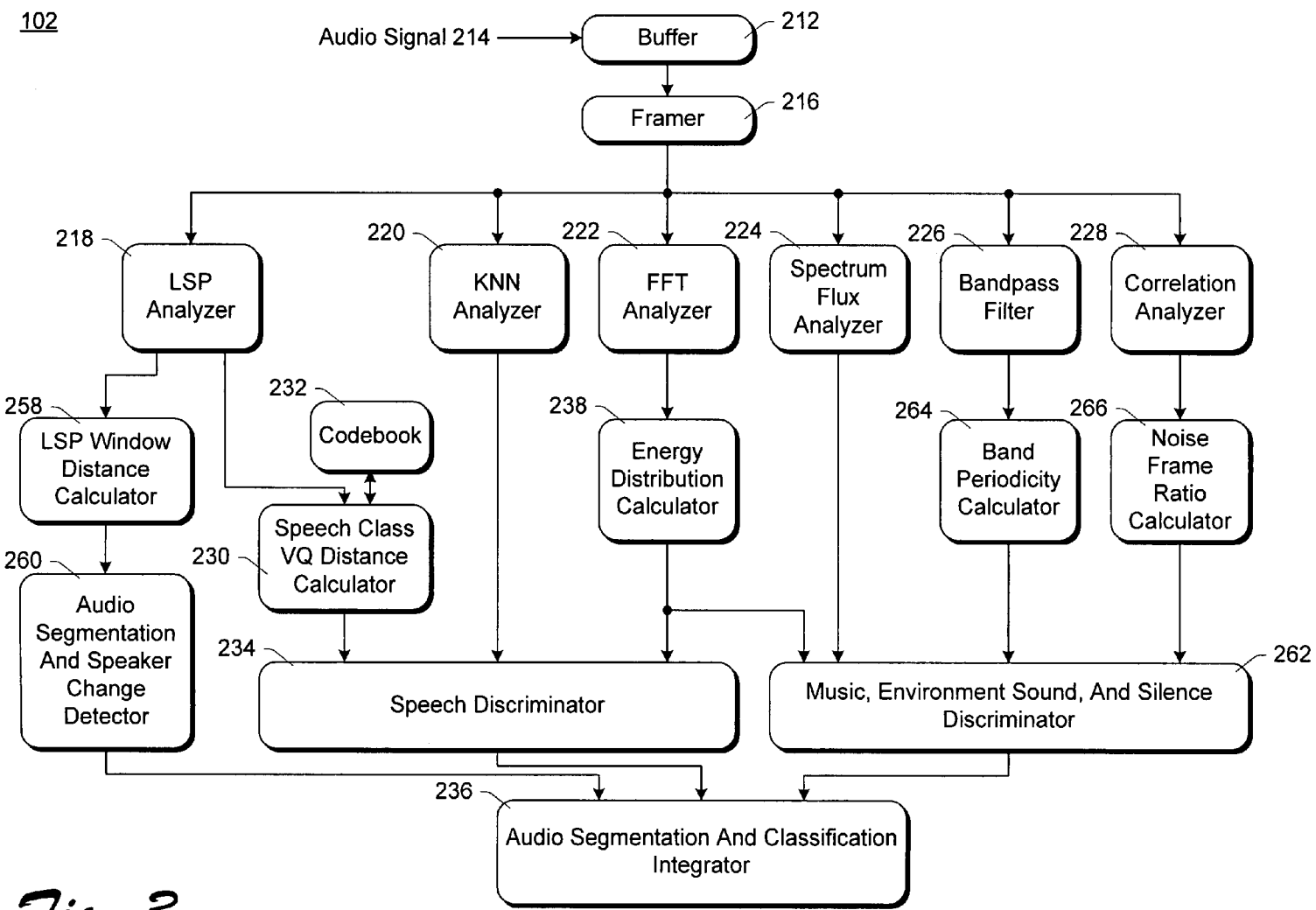
FIG. 3 is a more detailed block diagram illustrating an exemplary system for classifying and segmenting audio signals.

FIG. 3 is a more detailed block diagram illustrating an exemplary system for classifying and segmenting audio signals. System 102 includes a buffer 212 that receives a digital audio signal 214. Audio signal 214 can be received at system 102 in digital form or alternatively can be received at system 102 in analog form and converted to digital form by a conventional analog to digital (A/D) converter (not shown). In one implementation, buffer 212 stores at least one second of audio signal 214, which system 102 will classify as discussed in more detail below. Alternatively, buffer 212 may store different amounts of audio signal 214.

In the illustrated example, the digital audio signal 214 is sampled at 32 KHz per second. In the event that the source of audio signal 214 has sampled the audio signal at a higher rate, it is down sampled by system 102 (or alternatively another component) to 32 KHz for classification and segmentation.

Buffer 212 forwards a portion (e.g., one second) of signal 214 to framer 216, which in turn separates the portion of signal 214 into multiple non-overlapping sub-portions, referred to as "frames". In one implementation, each frame is a 25 millisecond (ms) sub-portion of the received portion of signal 214. Thus, by way of example, if the buffered portion of signal 214 is one second of audio signal 214, then framer 216 separates the portion into 40 different 25 ms frames.

The frames generated by framer 216 are input to a Line Spectrum Pair (LSP) analyzer 218, K-Nearest Neighbor (KNN) analyzer 220, Fast Fourier Transform (FFT) analyzer 222, spectrum flux analyzer 224, bandpass (BP) filter 226, and correlation analyzer 228. These analyzers and filter 218-228 extract various features of signal 214 from each frame. The use of such extracted features for classification and segmentation is discussed in more detail below. As illustrated, the frames of signal 214 are input to analyzers and filter 218-228 for concurrent processing by analyzers and filter 218-228. Alternatively, such processing may occur sequentially, or may only occur when needed (e.g., non-speech features may not be extracted if the portion of signal 214 is classified as speech).

LSP analyzer 218 extracts Line Spectrum Pairs (LSPs) for each frame received from framer 216. Speech can be described using the well-known vocal channel excitation model. The vocal channel in people (and many animals) forms a resonant system which introduces format structure to the envelope of speech spectrum. This structure is described using linear prediction (LP) coefficients. In one implementation, the LP coefficients are 10-order coefficients (i.e., 10-Dim vectors). The LP coefficients are then converted to LSPs. The calculation of LP coefficients and extraction of Line Spectrum Pairs from the LP coefficients are well known to those skilled in the art and thus will not be discussed further except as they pertain to the invention.

The extracted LSPs are input to a speech class vector quantization (VQ) distance calculator 230. Distance calculator 230 accesses a codebook 232 which includes trained Gaussian Models (GMs) used in classifying portions of audio signal 214 as speech or non-speech. Codebook 232 is generated using training speech data in any of a wide variety of manners, such as by using the LBG (Linde-Buzo-Gray) algorithm or K-Means Clustering algorithm. Gaussian Models are generated in a conventional manner from training speech data, which can include speech by different speakers, speakers of different ages and/or sexes, different conditions (e.g., different background noises), etc. A number of these Gaussian Models that are similar to one another are grouped together using conventional VQ clustering. A single "trained" Gaussian Model is then selected from each group (e.g., the model that is at approximately the center of a group, a randomly selected model, etc.) and is used as a vector in the training set, resulting in a training set of vectors (or "trained" Gaussian Models). The trained Gaussian Models are stored in codebook 232. In one implementation, codebook 232 includes four trained Gaussian Models. Alternatively, different numbers of code vectors may be included in codebook 232.

It should be noted that, contrary to traditional VQ classification techniques, only a single codebook 232 for the trained speech data is generated. An additional codebook for non-speech data is not necessary.

Distance calculator 230 also generates an input GM in a conventional manner based on the extracted LSPs for the frames in the portion of signal 214 to be classified. Alternatively, LSP analyzer 218 may generate the input GM rather than calculator 230. Regardless of which component generates the input GM, the distance between the input GM and the closest trained GM in codebook 232 is determined. The closest trained GM in codebook 232 can be identified in any of a variety of manners, such as calculating the distance between the input GM and each trained GM in codebook 232, and selecting the smallest distance.

The distance between the input GM and a trained GM can be calculated in a variety of conventional manners. In one implementation, the distance is generated according to the following calculation:

$$D(X, Y)=tr[(C_X-C_Y)(C_Y^{-1}-C_X^{-1})]$$

where D(X,Y) represents the distance between a Gaussian Model X and another Gaussian Model Y, $C_X$ represents the covariance matrix of Gaussian Model X, $C_Y$ represents the covariance matrix of Gaussian Model Y, and $C^{-1}$ represents the inverse of a covariance matrix.

Although discussed with reference to Gaussian Models, other models can also be used for discriminating between speech and non-speech. For example, conventional Gaussian Mixture Models (GMMs) could be used, Hidden Markov Models (HMMs) could be used, etc.

Calculator 230 then inputs the calculated distance to speech discriminator 234. Speech discriminator 234 uses the distance it receives from calculator 230 to classify the portion of signal 214 as speech or non-speech. If the distance is less than a threshold value (e.g., 20) then the portion of signal 214 is classified as speech; otherwise, it is classified as non-speech.

The speech/non-speech classification made by speech discriminator 234 is output to audio segmentation and classification integrator 236. Integrator 236 uses the speech/non-speech classification, possibly in conjunction with additional information received from other components, to determine the appropriate classification and segmentation information to output as discussed in more detail below.

Speech discriminator 234 may also optionally output an indication of its speech/non-speech classification to other components, such as filter 226 and analyzer 228. Filter 226 and analyzer 228 extract features that are used in discriminating among music, environment sound, and silence. If a portion of audio signal 214 is speech then the features extracted by filter 226 and analyzer 228 are not needed. Thus, the indication from speech discriminator 234 can be used to inform filter 226 and analyzer 228 that they need not extract features for that portion of audio signal 214.

In one implementation, speech discriminator 234 performs its classification based solely on the distance received from calculator 230. In alternative implementations, speech discriminator 234 relies on other information received from KNN analyzer 220 and/or FFT analyzer 222.

KNN analyzer 220 extracts two time domain features from each frame of a portion of audio signal 214: a high zero crossing rate ratio and a low short time energy ratio. The high zero crossing rate ratio refers to the ratio of frames with zero crossing rates higher than the 150% average zero crossing rate in one portion. The low short time energy ratio refers to the ratio of frames with short time energy lower than the 50% average short time energy in the portion. Spectrum flux is another feature used in KNN classification, which can be obtained by spectrum flux analyzer 224 as discussed in more detail below. The extraction of zero crossing rate and short time energy features from a digital audio signal is well known to those skilled in the art and thus will not be discussed further except as it pertains to the invention.

KNN analyzer 220 generates two codebooks (one for speech and one for non-speech) based on training data. This can be the same training data used to generate codebook 232 or alternatively different training data. KNN analyzer 220 then generates a set of feature vectors based on the low short time energy ratio, the high zero crossing rate ratio, and the spectrum flux (e.g., by concatenating these three values) of the training data. An input signal feature vector is also extracted from each portion of audio signal 214 (based on the low short time energy ratio, the high zero crossing rate ratio, and the spectrum flux) and compared with the feature vectors in each of the codebooks. Analyzer 220 then identifies the nearest K vectors, considering vectors in both the speech and non-speech codebooks (K is typically selected as an odd number, such as 3 or 5).

Speech discriminator 234 uses the information received from KNN classifier 220 to pre-classify the portion as speech or non-speech. If there are more vectors among the K nearest vectors from the speech codebook than from the non-speech codebook, then the portion is pre-classified as speech. However, if there are more vectors among the K nearest vectors from the non-speech codebook than from the speech codebook, then the portion is pre-classified as non-speech. Speech discriminator 234 then uses the result of the pre-classification to determine a distance threshold to apply to the distance information received from speech class VQ distance calculator 230. Speech discriminator 234 applies a higher threshold if the portion is pre-classified as non-speech than if the portion is pre-classified as speech. In one implementation, speech discriminator 234 uses a zero decibel (dB) threshold if the portion is pre-classified as speech, and uses a 6 dB threshold if the portion is pre-classified as non-speech.

Alternatively, speech discriminator 234 may utilize energy distribution features of the portion of audio signal 214 in determining whether to classify the portion as speech. FFT analyzer 222 extracts FFT features from each frame of a portion of audio signal 214. The extraction of FFT features from a digital audio signal is well known to those skilled in the art and thus will not be discussed further except as it pertains to the invention. The extracted FFT features are input to energy distribution calculator 238. Energy distribution calculator 238 calculates, based on the FFT features, the energy distribution of the portion of the audio signal 214 in each of two different bands. In one implementation, the first of these bands is 0 to 4,000 Hz (the 4 kHz band) and the second is 0 to 8,000 Hz (the 8 kHz band). The energy distribution in each of these bands is then input to speech discriminator 234.

Speech discriminator 234 determines, based on the distance information received from distance calculator 230 and/or the energy distribution in the bands received from energy distribution calculator 238, whether the portion of audio signal 214 is to be classified as speech or non-speech.

Figure 4:
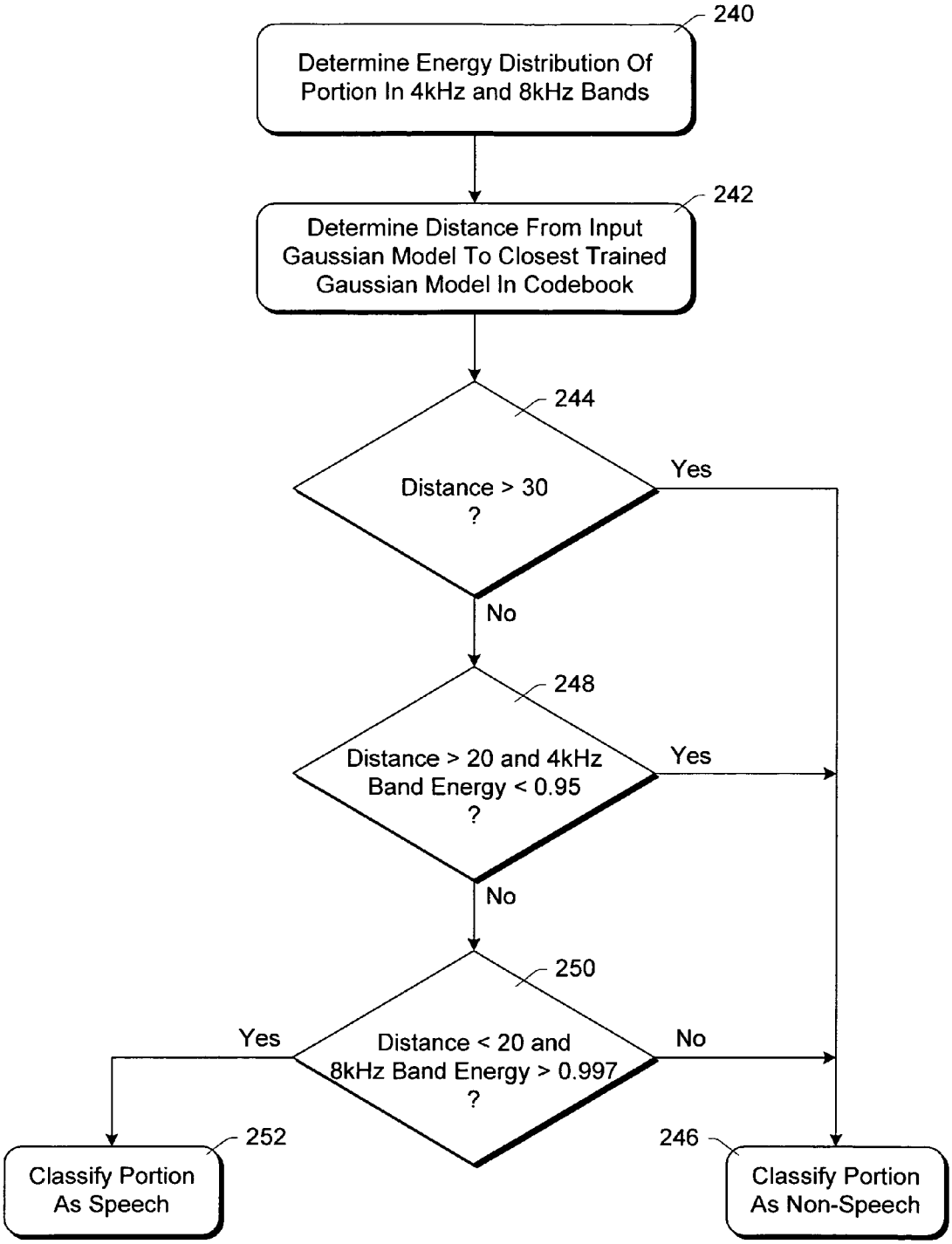
FIG. 4 is a flowchart illustrating an exemplary process for discriminating between speech and non-speech in accordance with one embodiment of the invention.

FIG. 4 is a flowchart illustrating an exemplary process for discriminating between speech and non-speech in accordance with one embodiment of the invention. The process of FIG. 4 is implemented by calculators 230 and 238, and speech discriminator 234 of FIG. 3, and may be performed in software. FIG. 4 is described with additional reference to components in FIG. 3.

Initially, energy distribution calculator 238 determines the energy distribution of the portion of signal 214 in the 4 kHz and 8 kHz bands (act 240) and speech to class VQ distance calculator 230 determines the distance from the input GM (corresponding to the portion of signal 214 being classified) and the closest trained GM (act 242).

Speech discriminator 234 then checks whether the distance determined in act 242 is greater than 30 (act 244). If the distance is greater than 30, then discriminator 234 classifies the portion as non-speech (act 246). However, if the distance is not greater than 30, then discriminator 234 checks whether the distance determined in act 242 is greater than 20 and the energy in the 4 kHz band determined in act 240 is less than 0.95 (act 248). If the distance determined is greater than 20 and the energy in the 4 kHz band is less than 0.95, then discriminator 234 classifies the portion as non-speech (act 246).

However, if distance determined is not greater than 20 and/or the energy in the 4 kHz band is not less than 0.95, then discriminator 234 checks whether the distance determined in act 242 is less than 20 and whether the energy in the 8 kHz band determined in act 240 is greater than 0.997 (act 250). If the distance is less than 20 and the energy in the 8 kHz band is greater than 0.997, then the portion is classified as speech (act 252); otherwise, the portion is classified as non-speech (act 246).

Returning to FIG. 3, LSP analyzer 218 also outputs the LSP features to LSP window distance calculator 258. Calculator 258 calculates the distance between the LSPs for successive windows of audio signal 214, buffering the extracted LSPs for successive windows (e.g., for two successive windows) in order to perform such calculations. These calculated distances are then input to audio segmentation and speaker change detector 260. Detector 260 compares the calculated distances to a threshold value (e.g., 4.75) and determines an audio segment boundary exists between two windows if the distance between those two windows exceeds the threshold value. Audio segment boundaries refer to changes in speaker if the analyzed portion(s) of the audio signal are speech, and refers to changes in classification if the analyzed portion(s) of the audio signal include non-speech.

In one implementation the size of such a window is three seconds (e.g., corresponding to 120 consecutive 25 ms frames). Alternatively, different window sizes could be used. Increasing the window size increases the accuracy of the audio segment boundary detection, but reduces the time resolution of the boundary detection (e.g., if windows are three seconds, then boundaries can only be detected down to a three-second resolution), thereby increasing the chances of missing a short audio segment (e.g., less than three seconds). Decreasing the window size increases the time resolution of the boundary detection, but also increases the chances of an incorrect boundary detection.

Calculator 258 generates an LSP feature for a particular window that represents the LSP features of the individual frames in that window. The distance between LSP features of two different frames or windows can be calculated in any of a variety of conventional manners, such as via the well-known likelihood ratio or non-parameter techniques. In one implementation, the distance between two LSP features set X and Y is measured using divergence. Divergence is defined as follows:

$$D = J_{XY} = I(X, Y) + I(Y, X) = \int_{\xi} [p_X(\xi) - p_Y(\xi)] \ln \frac{p_X(\xi)}{p_Y(\xi)} d\xi$$

where D represents the distance between two LSP features set X and Y, $p_X$ is the probability density function (pdf) of X, and $p_Y$ is the pdf of Y. The assumption is made that the feature pdfs are well-known n-variant normal populations, as follows:

$$p_X(\xi) \approx N(\mu_X, C_X)$$

$$p_Y(\xi) \approx N(\mu_Y, C_Y)$$

Divergence can then be represented in a compact form:

$$D = J_{XY} = \frac{1}{2} tr[(C_X - C_Y)(C_Y^{-1} - C_X^{-1})] + \frac{1}{2} tr[(C_X^{-1} + C_Y^{-1})(\mu_X - \mu_Y)(\mu_X - \mu_Y)^T]$$

where tr is the matrix trace function, $C_X$ represents the covariance matrix of X, $C_Y$ represents the covariance matrix of Y, $C^{-1}$ represents the inverse of a covariance matrix, $\mu_X$ represents the mean of X, $\mu_Y$ represents the mean of Y, and T represents the operation of matrix transpose. In one implementation, only the beginning part of the compact form is used in determining divergence, as indicated in the following calculation:

$$D = \frac{1}{2} tr[(C_X - C_Y)(C_Y^{-1} - C_X^{-1})]$$

Audio segment boundaries are then identified based on the distance between the current window and the previous window ($D_i$), the distance between the previous window and the window before that ($D_{i-1}$), and the distance between the current window and the next window ($D_{i+1}$). Detector 260 uses the following calculation to determine whether an audio segment boundary exists:

$$D_{i-1} < D_i \text{ and } D_{i+1} < D_i$$

This calculation helps ensure that a local peak exists for detecting the boundary. Additionally, the distance $D_i$ must exceed a threshold value (e.g., 4.75). If the distance $D_i$ does not exceed the threshold value, then an audio segment boundary is not detected.

Detector 260 outputs audio segment boundary indications to integrator 236. Integrator 236 identifies audio segment boundary indications as speaker changes if the audio signal is speech, and identifies audio segment boundary indications as changes in homogeneous non-speech segments if the audio signal is non-speech. Homogeneous segments refer to one or more sequential portions of audio signal 214 that have the same classification.

System 102 also includes spectrum flux analyzer 224, bandpass filter 226, and correlation analyzer 228. Spectrum flux analyzer 224 analyzes the difference between FFTs in successive frames of the portion of audio signal 214 being classified. The FFT features can be extracted by analyzer 224 itself from the frames output by framer 216, or alternatively analyzer 224 can receive the FFT features from FFT analyzer 222. The average difference between successive frames in the portion of audio signal 214 is calculated and output to music, environment sound, and silence discriminator 262. Discriminator 262 uses the spectrum flux information received from spectrum flux analyzer 224 in classifying the portion of audio signal 214 as music, environment sound, or silence, as discussed in more detail below.

Discriminator 262 also makes use of two periodicity features in classifying the portion of audio signal 214 as music, environment sound, or silence. These periodicity features are referred to as noise frame ratio and band periodicity, and are discussed in more detail below.

Bandpass filter 226 filters particular frequencies from the frames of audio signal 214 and outputs these bands to band periodicity calculator 264. In one implementation, the bands passed to calculator 264 are 500 Hz to 1000 Hz, 1000 Hz to 2000 Hz, 2000 Hz to 3000 Hz, and 3000 Hz to 4000 Hz. Band periodicity calculator 264 receives these bands and determines the periodicity of the frames in the portion of audio signal 214 for each of these bands. Additionally, once the periodicity of each of these four bands is determined, a "full band" periodicity is calculated by summing the four individual band periodicities.

The band periodicity can be calculated in any of a wide variety of known manners. In one implementation, the band periodicity for one of the four bands is calculated by initially calculating a correlation function for that band. The correlation function is defined as follows:

$$r(m) = \frac{\sum_{n=0}^{N-1} x(n+m)x(n)}{\left[\sum_{n=0}^{N-1} x^2(n)\right]^{\frac{1}{2}}\left[\sum_{n=0}^{N-1} x^2(n+m)\right]^{\frac{1}{2}}}$$

where x(n) is the input signal, N is the window length, and r(m) represents the correlation function of one band of the portion of audio signal 214 being classified. The maximum local peak of the correlation function for each band is then located in a conventional manner.

Additionally, the DC-removed full-wave regularity signal is also used for the calculation of correlation coefficient. The DC-full-wave regularity signal is calculated as follows. First, the absolute value of the input signal is calculated and then passed through a digital filter. The transform function of the digital filter is:

$$H(z) = \frac{1 - bz^{-1}}{(1 - az^{-1})(1 + a^{*}z^{-1})}$$

The variables a and b can be determined by experiment, a is the conjunctive of a. In one implementation, the value of a is 0.97*exp(j*0.1407), with j equaling the square root of −1, and the value of b is 1. Then the correlation function of the DC-removed full-wave regularity is calculated. A constant is removed from the full-wave regularity signal correlation function. In one implementation this constant is the value 0.1. The larger of the maximum local peak of the correlation function of the input signal and its DC-removed full-wave regularity signal is then selected as the measure of periodicity of that band.

Correlation analyzer 228 operates in a conventional manner to generate an autocorrelation function for each frame of the portion of audio signal 214. The autocorrelation functions generated by analyzer 228 are input to noise frame ratio calculator 266. Noise frame ratio calculator 266 operates in a conventional manner to generate a noise frame ratio for the portion of audio signal 214, identifying a percentage of the frames that are noise-like.

Discriminator 262 also receives the energy distribution information from calculator 238. The energy distribution across the 4 kHz and 8 kHz bands may be used by discriminator 262 in classifying the portion of audio signal 214 as music, silence, or environment sound, as discussed in more detail below.

Discriminator 262 further uses the full bandwidth energy in determining whether the portion of audio signal 214 is silence. This full bandwidth energy may be received from calculator 238, or alternatively generated by discriminator 262 based on FFT features received from FFT analyzer 222 or based on the information received from calculator 238 regarding the energy distribution in the 4 kHz and 8 kHz bands. In one implementation, the energy in the portion of the signal 214 being classified is normalized to a 16-bit signed value, allowing for a maximum energy value of 32,768, and discriminator 262 classifies the portion as silence only if the energy value of the portion is less than 20.

Discriminator 262 classifies the portion of audio signal 214 as music, environment sound, or silence based on various features of the portion. Discriminator 262 applies a set of rules to the information it receives and classifies the portion accordingly. One set of rules is illustrated in Table I below. The rules can be applied in the order of their presentation, or alternatively can be applied in different orders.

TABLE I

| | Rule | Result |
|---|---|---|
| 1: | Overall energy is less than 20 | Silence |
| 2: | Noise frame ratio is greater than 0.45 or full band periodicity is less than 2.1 or periodicity in band 500~1000 Hz is less than 0.6 or periodicity in band 1000~2000 Hz is less than 0.5 | Environmental sound |
| 3: | Energy distribution in 8 kHz band is less than 0.2 and/or spectrum flux is greater than 12 and/or less than 2 | Environmental Sound |
| 4: | Full band periodicity is greater than 3.8 | Environmental sound |
| 5: | None of rules 1, 2, 3, or 4 is true | Music |

System 102 can also optionally classify portions of audio signal 214 which are music as either music with vocals or music without vocals. This classification can be performed by discriminator 262, integrator 238, or an additional component (not shown) of system 102. Discriminating between music with vocals and music without vocals for a portion of audio signal 214 is based on the periodicity of the portion. If the periodicity of any one of the four bands (500 Hz to 1000 Hz, 1000 Hz to 2000 Hz, 2000 Hz to 3000 Hz, or 3000 Hz to 4000 Hz) falls within a particular range (e.g., is lower than a first threshold and higher than a second threshold), then the portion is classified as music with vocals. If all of the bands are lower than the second threshold, then the portion is classified as environment sound; otherwise, the portion is classified as music without vocals. In one implementation, the exact values of these two thresholds are determined experimentally.

Figure 5:
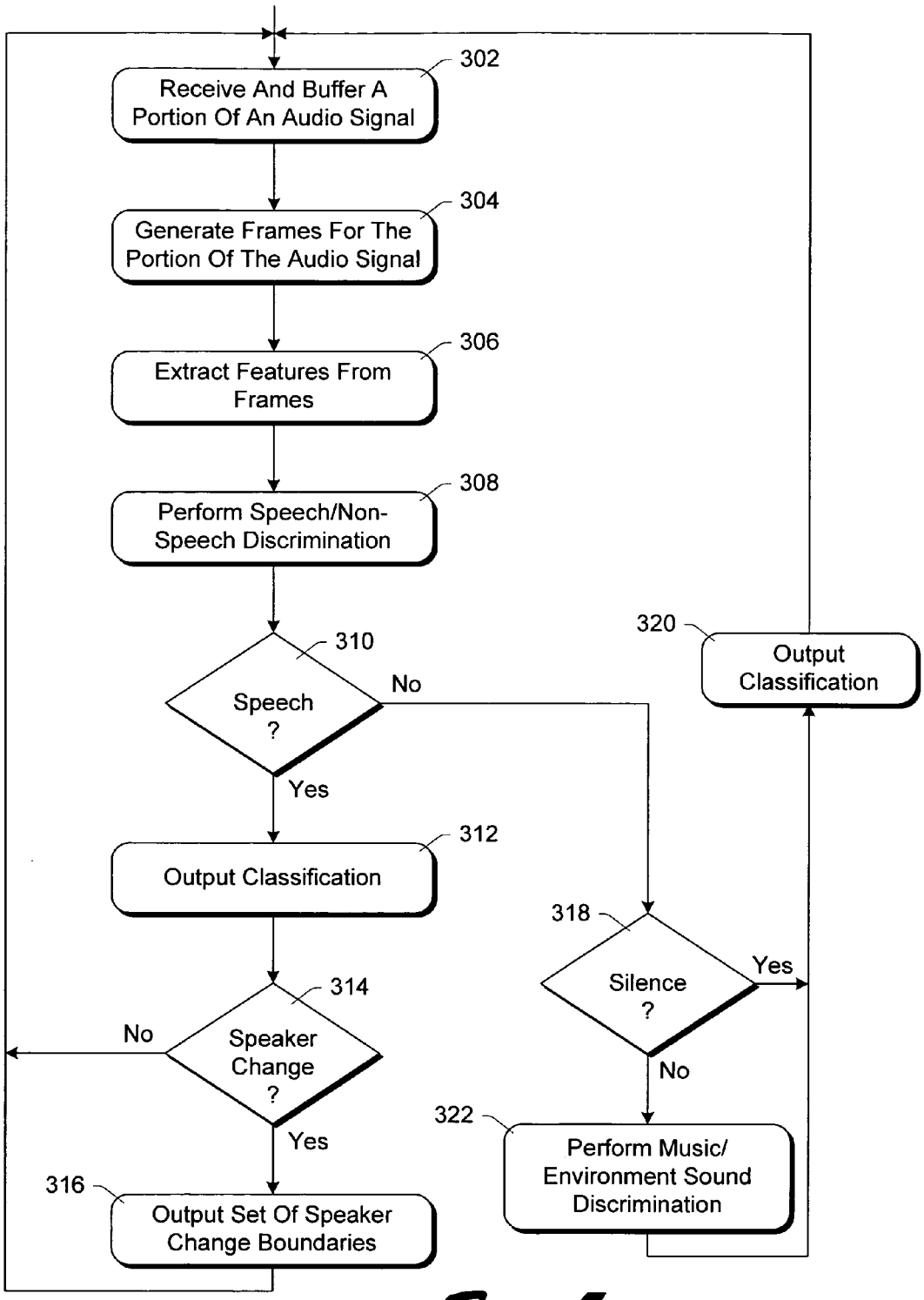
FIG. 5 is a flowchart illustrating an exemplary process for classifying a portion of an audio signal as speech, music, environment sound, or silence in accordance with one embodiment of the invention.

FIG. 5 is a flowchart illustrating an exemplary process for classifying a portion of an audio signal as speech, music, environment sound, or silence in accordance with one embodiment of the invention. The process of FIG. 5 is implemented by system 102 of FIG. 3, and may be performed in software. FIG. 5 is described with additional reference to components in FIG. 3.

A portion of an audio signal is initially received and buffered (act 302). Multiple frames for a portion of the audio signal are then generated (act 304). Various features are extracted from the frames (act 306) and speech/non-speech discrimination is performed using at least a subset of the extracted features (act 308).

If the portion is speech (act 310), then a corresponding classification (i.e., speech) is output (act 312). Additionally, a check is made as to whether the speaker has changed (act 314). If the speaker has not changed, then the process returns to continue processing additional portions of the audio signal (act 302). However, if the speaker has changed, then a set of speaker change boundaries are output (act 316). In some implementations, multiple speaker changes may be detectable within a single portion, thereby allowing the set to identify multiple speaker change boundaries for a single portion. In alternative implementations, only a single speaker change may be detectable within a single portion, thereby limiting the set to identify a single speaker change boundary for a single portion. The process then returns to continue processing additional portions of the audio signal (act 302).

Returning to act 310, if the portion is not speech then a determination is made as to whether the portion is silence (act 318). If the portion is silence, then a corresponding classification (i.e., silence) is output (act 320). The process then returns to continue processing additional portions of the audio signal (act 302). However, if the portion is not silence then music/environment sound discrimination is performed using at least a subset of the features extracted in act 306. The corresponding classification (i.e., music or environment sound) is then output (act 320), and the process returns to continue processing additional portions of the audio signal (act 302).

Conclusion

Thus, improved audio segmentation and classification has been described. Audio segments with different speakers and different classifications can advantageously be identified. Additionally, portions of the audio can be classified as one of multiple different classes (for example, speech, silence, music, or environment sound). Furthermore, classification accuracy between some classes can be advantageously improved by using periodicity features of the audio signal.

Although the description above uses language that is specific to structural features and/or methodological acts, it is to be understood that the invention defined in the appended claims is not limited to the specific features or acts described. Rather, the specific features and acts are disclosed as exemplary forms of implementing the invention.

The invention claimed is:

1. A method comprising:

separating at least a portion of an audio signal into a plurality of frames;

extracting a periodicity feature for each of the plurality of frames; and using at least the periodicity feature to classify the plurality of frames as either music with vocals or music without vocals.

2. A method as recited in claim 1, wherein the periodicity feature comprises a band periodicity for each of a plurality of bands of the audio signal.

3. A method as recited in claim 2, further comprising classifying at least the portion as music with vocals if the band periodicity of at least one of the plurality of bands is greater than a first threshold and less than a second threshold.

4. A method as recited in claim 3, further comprising classifying at least the portion as environment sound if the band periodicity of each of the plurality of bands is less than the second threshold, and otherwise classifying at least the portion as music without vocals.

5. An apparatus comprising:

a band periodicity calculator to determine a periodicity of each of a plurality of bands of a portion of an audio signal; and a discriminator, communicatively coupled to the band periodicity calculator, to classify the portion of the audio signal as music with vocals or music without vocals based at least in part on the periodicity of one of the plurality of bands.

6. An apparatus as recited in claim 5, further comprising:

a noise frame ratio calculator, communicatively coupled to the discriminator, to determine a noise frame ratio of the portion of the audio signal; and wherein the discriminator is to classify the portion of the audio signal as music with vocals or music without vocals based at least in part on the periodicity of one of the plurality of bands and on the noise frame ratio of the portion.

7. An apparatus as recited in claim 5, further comprising:

a spectrum flux analyzer, communicatively coupled to the discriminator, to determine a spectrum flux of the portion of the audio signal; and wherein the discriminator is to classify the portion of the audio signal as music with vocals or music without vocals based at least in part on the periodicity of one of the plurality of bands and on the spectrum flux of the portion.

8. An apparatus as recited in claim 5, wherein the discriminator is to classify the portion of the audio signal as music with vocals or music without vocals based at least in part on the periodicity of one of the plurality of bands and separately from any determination of whether the portion can be classified as speech.

* * * * *